US008164526B1

(12) United States Patent
Aula et al.

(10) Patent No.: US 8,164,526 B1
(45) Date of Patent: Apr. 24, 2012

(54) SINGLE WIRE INTERNAL ANTENNA WITH INTEGRAL CONTACT FORCE SPRING

(75) Inventors: Janne Aula, Oulu (FI); Mika Piisila, Kempele (FI); Mikko Ojala, Oulu (FI)

(73) Assignee: Flextronics AP, LLC, Broomfield, CO (US)

( * ) Notice: Subject to any disclaimer, the term of this patent is extended or adjusted under 35 U.S.C. 154(b) by 820 days.

(21) Appl. No.: 12/290,846

(22) Filed: Nov. 3, 2008
(Under 37 CFR 1.47)

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

| | | | | |
|---|---|---|---|---|
| 4,210,404 | A | 7/1980 | Hanger | |
| 5,151,233 | A | 9/1992 | Wendt | |
| 5,764,190 | A | 6/1998 | Murch et al. | 343/702 |
| 6,140,966 | A | 10/2000 | Pankinaho | 343/700 |
| 6,624,432 | B1 | 9/2003 | Gabower et al. | |
| 6,680,705 | B2 | 1/2004 | Tan et al. | 343/702 |
| 6,693,594 | B2 | 2/2004 | Pankinaho et al. | 343/700 |
| 6,792,246 | B2 | 9/2004 | Takeda et al. | 455/41.1 |
| 6,816,076 | B2 | 11/2004 | Pomes | |
| 7,026,996 | B2 | 4/2006 | Harano | 343/700 |
| 7,026,999 | B2 | 4/2006 | Umehara et al. | 343/702 |
| 7,119,743 | B2 | 10/2006 | Iguchi et al. | 343/700 |
| 7,136,019 | B2 * | 11/2006 | Mikkola et al. | 343/702 |
| 7,319,432 | B2 | 1/2008 | Andersson | 373/702 |
| 7,375,689 | B2 * | 5/2008 | Chen et al. | 343/702 |
| 7,385,561 | B2 * | 6/2008 | Krupa | 343/728 |
| 7,639,192 | B2 * | 12/2009 | Tsai et al. | 343/702 |
| 2002/0102946 | A1 | 8/2002 | San Giovanni | 455/90 |
| 2005/0007283 | A1 | 1/2005 | Jo et al. | 343/702 |
| 2005/0195124 | A1 | 9/2005 | Puente Baliarda et al. | 343/890 |
| 2007/0139280 | A1 | 6/2007 | Vance | 343/702 |
| 2009/0229108 | A1 | 9/2009 | Shambline et al. | |

FOREIGN PATENT DOCUMENTS

| | | | |
|---|---|---|---|
| CN | 1324012 | A | 11/2001 |
| EP | 1 018 779 | B1 | 7/2000 |
| EP | 1 108 616 | A2 | 6/2001 |
| WO | WO 01/82412 | A2 | 11/2001 |

* cited by examiner

*Primary Examiner* — Hoang V Nguyen
(74) *Attorney, Agent, or Firm* — Haverstock & Owens LLP

(57) ABSTRACT

Some embodiments of the present invention are internal antennae for mobile devices. For example, an internal antenna for a mobile device that is a continuous length of wire formed into a collection of antenna features. Other embodiments relate to methods of manufacturing internal antennae for mobile devices; for example, manufacturing an internal antenna for a mobile device from a continuous length of wire. Still other embodiments relate to an iterative antenna production and re-design cycle. Preferably, antennae consistent with some embodiments of the invention include multiple radiator portions, a contact region, and integral configured to form a torsion spring of the contact region and parts of the radiator portions that reacts against displacement of the contact region toward those parts of the radiator portions.

22 Claims, 7 Drawing Sheets

SINGLE WIRE INTERNAL ANTENNA WITH INTEGRAL CONTACT FORCE SPRING

FIELD OF THE INVENTION

The embodiments of the present invention relate to antennae for mobile devices, and specifically to antennae formed from continuous lengths of wire.

BACKGROUND OF THE INVENTION

Mobile devices are rapidly becoming commodity items. Increasingly, successful manufacturers compete not only on price, but differentiate their products via unique interfaces, device packages or other features. As consumer tastes shift, short product cycles and rapidity-to-market are at a premium.

Furthermore, mobile devices must continue to evolve, supporting a variety of activities inherent in their emerging status as primary communication devices. These devices, which include mobile phones as well as PDAs like BlackBerry™ and notebook computers equipped with mobile connectivity cards, must handle relatively high bandwidth communications such as IMAP email, graphical web browsing, and the like, not to mention bandwidth intensive applications such as video streaming or IP telephony. Because the majority of all mobile communications rely on device antennae, requirements placed on mobile device antennae are ever-increasing.

Antennae are key contributors to the quality of devices' communications capabilities. Further, they must conform to size, shape and volume constraints as mobile devices are produced with form factors of ever-decreasing size. In addition, they must meet stringent requirements for electronic interference, safety, and other regulated characteristics.

Antennae must also be easy and cheap to manufacture, as well as cheap and easy to re-design. To shorten the mobile device products cycle, the lead times required for all hardware component design, manufacture, and re-design must decrease. However, quality should not fall below consumer tolerances.

Currently, even cheaply produced reliable antennae require long hardware design and manufacture lead times. For example, planar antennae provide a popular solution to the antenna problem. Though these antennae have a high initial cost—in both time and in money—they have a relatively low marginal cost to manufacture. They are lightweight and low volume to fit ever-shrinking device packaging.

There are a variety of constructions known for planar antennae, including stamped sheet metal and metal layered on printed circuit board (PCB). However, all of these methods require lead-time to set up custom tooling or etch masks to produce every new planar antenna design. Thus, for each modification to the antenna design, tool and etch mask changes require days or weeks of delay, lengthening the product re-design cycle.

Furthermore, planar antenna designs are sensitive to material selection, and design changes may necessitate material shifts. This requires manufacturers to maintain a diverse array of materials on hand, and pay the accompanying carrying costs, even during re-design lead-time delays.

In addition, these planar designs are typically produced as separate components from the main circuitry of the device, and thus require specialized adaptation for connection to the device electrical system. Often these connections are made galvanically and the antenna held in place via spring forces. For example, as shown in FIG. 1C, the planar antenna section 200" includes a body 201" coupled with a separate spring clip 210". The spring clip 210" is deformed upon mounting to the device body, producing a force directed along the arrow. This force holds a contact in place, providing electrical connection between the antenna 200" and the main circuitry of the device (not shown). The need to include and engineer for separate forcing clips adds cost and complexity to the antenna design.

Another type of antenna design requires high initial costs, high manufacturing costs, exotic materials, and separate connector components. These sintered metal antennae are currently used in high-end devices optimized for performance.

For example, a two-part sintered antenna system is shown in FIGS. 1A and 1B. The antenna assembly 200 of the two-part system is shown in FIG. 1A. The antenna assembly 200 includes the radiator 220, which is mounted on a support chassis 210.

The radiator 220 includes a folded portion 222 and a stem 224. The stem 224 is adapted for interface with an antenna coupling spring (210' of FIG. 1B). The support chassis 210 includes an upstanding portion 212 that is adapted to interface with and support the radiator 220. The radiator 220 is mounted to the upstanding portion 212 of the support chassis 210 so that the stem 224 is aligned along a planar surface of the support chassis 210.

The shape of the radiator 220 is determined via a unique molding-and-sintering process. A specific mold is produced in the shape desired, metal powder is inserted into the mold along with a binder, then the resulting shape is sintered to produce a shaped piece of metal. To improve conductivity, the shape is then surface coated with a highly conductive material, such as gold.

The main circuit assembly 200' of a two-part sintered antenna system is shown in FIG. 1B. The main circuit assembly 200' includes the board 201', preferably a printed circuit board (PCB). Various internal components and couplings of the main circuit assembly 200' are mounted to the board 201'.

As illustrated, the main circuit assembly 200' includes the antenna processor 220' and the control circuit 230'. The antenna processor 220' is coupled to the control circuit 230' via the primary coupling 204' and the secondary coupling 203'. In addition, both the antenna processor 220' and the control circuit 230' components communicate with interfaces and couplings of the mobile device (not shown) external to the main circuit assembly 200'. The components are also coupled with the antenna assembly 200 of the two-part system.

The antenna processor 220' is connected to an antenna contact interface 210'. The connection is made via the antenna input coupling 202'. The antenna contact interface 210' of the main circuit assembly 200' is adapted to interface with the stem 224 of the radiator 220 and provide sufficient contact force at the interface to facilitate both electrical communications and some measure of physical stability.

The antenna contact interface 210' includes the contact spring fins 212', which are positioned and configured to interface with the stem 224 of the radiator 220. The spring fins 212' are constructed of a conductive, resilient material. Coupling the stem 224 to the spring fins 212' causes the fins 212' to deform away from each other, forming a stress that forces the fins 212' against the surface of the stem 224. This forcing produces a contact force sufficient to facilitate electrical communications and retention of the stem 224 within the contact interface 210'.

Thus, the construction of an antenna system around a sintered-metal radiator requires not only a specialized mold and an exotic coating, but also separate elements to provide coupling force between the radiator and the device circuitry. The forming methods require lead-time to set up custom tooling and molds to produce every new or revised antenna design. Thus, for each modification to the antenna design, tool and mold changes require days or weeks of delay, lengthening the product re-design cycle. In addition, the need to include and engineer for separate forcing springs adds cost and complexity to the antenna design.

What is needed is a method or design of antenna that maintains quality and maintains or lowers incremental costs while shortening lead-time for redesign, implementation and manufacture.

What is needed is a method or design of antenna that permits a variety of antenna designs, specifications and capabilities to be produced via a single machine and/or type of material, dramatically reducing the stock value of raw materials needed to avoid manufacturing slow-downs.

A method that would permit a design change to enter production within a few hours, and with substantially the same raw-materials input, would dramatically lower the cost of manufacture for mobile device antennae.

What is also needed is a method or design of antenna that integrates contact spring functionality into the antenna radiator itself.

SUMMARY OF INVENTION

Some embodiments of the present invention are internal antennae for mobile devices. For example, an internal antenna for a mobile device, comprising a continuous length of wire formed into a collection of antenna features.

In some embodiments, the continuous length of wire is formed into a main grouping of portions of the wire, a contact region, a first radiator portion, and a second radiator portion. The contact region is configured to extend away from the main grouping.

The first radiator portion comprises a portion of the main grouping and is electrically coupled to the contact region. The first radiator portion is also configured such that in operation the first radiator portion acts as a first resonator having a first electrical length.

The second radiator portion also comprises a portion of the main grouping and is also electrically coupled to the contact region. In addition, the first radiator portion is configured such that in operation the second radiator portion acts as a second resonator having a second electrical length. Preferably, the second electrical length is greater than the first electrical length.

Some other embodiments relate to methods of manufacturing internal antennae for mobile devices; for example, manufacturing an internal antenna for a mobile device from a continuous length of wire.

A method of manufacturing an antenna for a mobile device from a continuous length of wire comprises several steps. The wire has a first end and a second end. The steps operate on sub-lengths of the wire. A first step includes forming a first radiator portion from a first sub-length of the wire starting at the first end of the wire. A second step includes forming a contact region from a second sub-length of the wire starting adjacent to an end of the first sub-length. A third step includes forming a second radiator portion from a third sub-length of the wire starting adjacent to an end of the second sub-length and extending to the second end of the wire. Preferably methods consistent with the present invention are performed by a programmable wire-forming machine.

Some embodiments relate to an iterative antenna production and re-design cycle. For example, consistent with the present invention, an iterative production and re-design cycle includes the steps: programming a wire-forming machine to produce a first type of antenna from a continuous length of wire, producing the first type of antenna with the wire-forming machine from a continuous length of wire, reprogramming the machine to produce a second type of antenna from a continuous length of wire, and producing a second type of antenna from a continuous length of wire.

Preferably, the first type of antenna includes: a main grouping of portions of the wire, a contact region, a first type of radiator portion, and a second type of radiator portion.

The contact region is configured to extend away from the main grouping. The first type of radiator portion comprises a portion of the main grouping, electrically coupled to the contact region, and configured such that in operation the first type of radiator portion acts as a first resonator having a first electrical length. The second type of radiator portion comprises a portion of the main grouping, electrically coupled to the contact region, and configured such that in operation the second type of radiator portion acts as a second resonator having a second electrical length, wherein the second electrical length is greater than the first electrical length.

Preferably, second type of antenna includes: a main grouping of portions of the wire, a contact region, a third type of radiator portion, and a fourth type of radiator portion.

The contact region is configured to extend away from the main grouping. The third type of radiator portion comprises a portion of the main grouping, electrically coupled to the contact region, and configured such that in operation the third type of radiator portion acts as a third resonator having a third electrical length different from the first electrical length. The fourth type of radiator portion comprises a portion of the main grouping, electrically coupled to the contact region, and configured such that in operation the fourth type of radiator portion acts as a fourth resonator having a second electrical length, wherein the fourth electrical length is greater than the third electrical length.

DESCRIPTION OF THE SEVERAL DRAWING FIGURES

DETAILED DESCRIPTION OF THE EMBODIMENTS OF THE INVENTION

The description below concerns several embodiments of the invention. The discussion references the illustrated preferred embodiment. However, the scope of the present invention is not limited to either the illustrated embodiment, nor is it limited to those discussed, to the contrary, the scope should be interpreted as broadly as possible based on the language of the claims appended hereto.

Specifically, the embodiment of the invention described has a certain shape and configuration. Not all aspects of this configuration are necessary parts the invention. Further, an antenna having a similar shape does not inherently include the features of this invention.

Structure

Figure 1A:
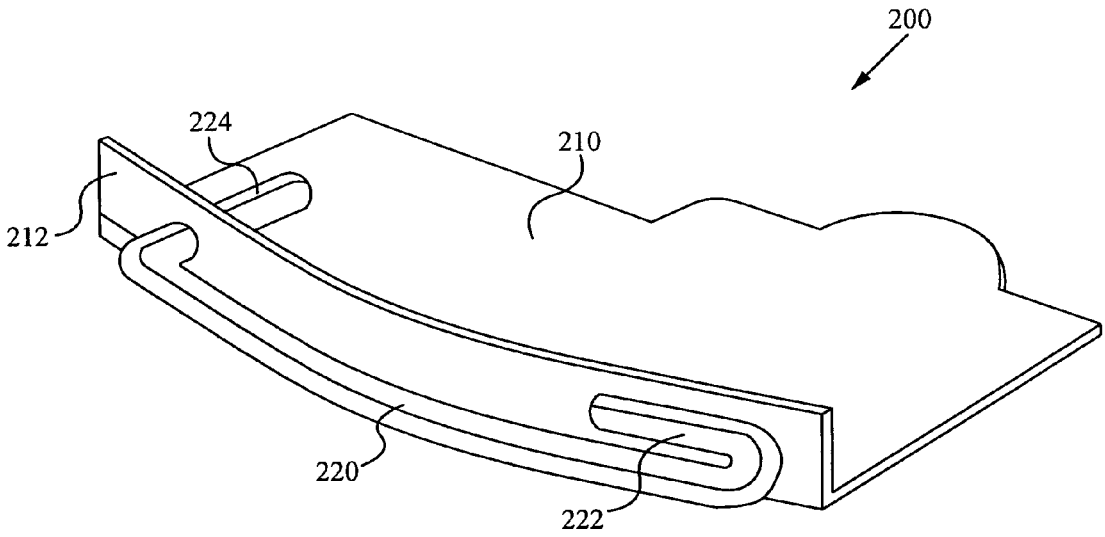
FIG. 1A illustrates a first component of a dual-component wire antenna for a mobile device.
Figure 1B:
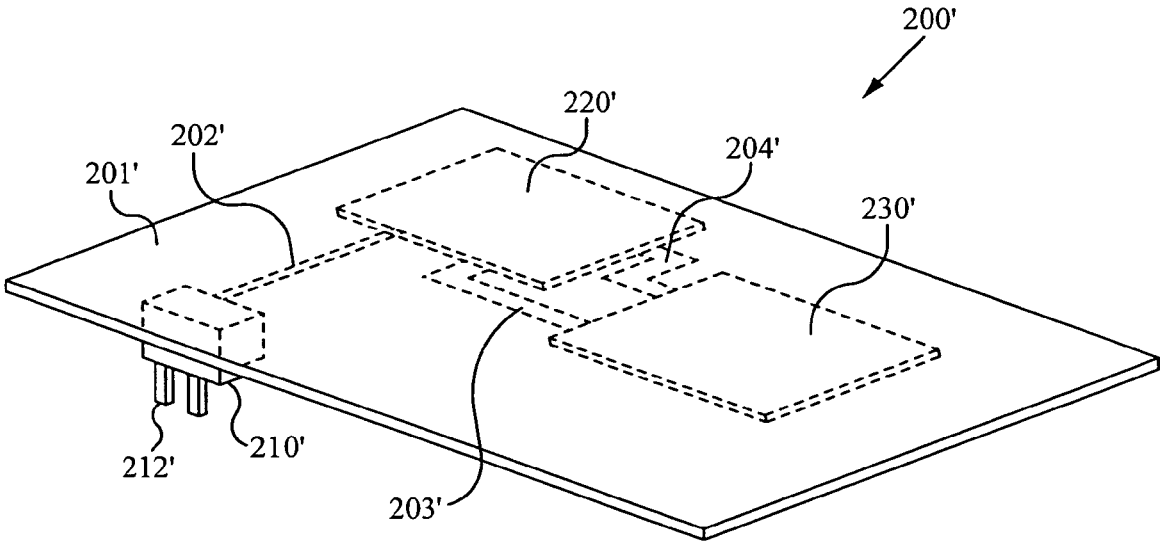
FIG. 1B illustrates a second component of a dual-component wire antenna for a mobile device.
Figure 1C:
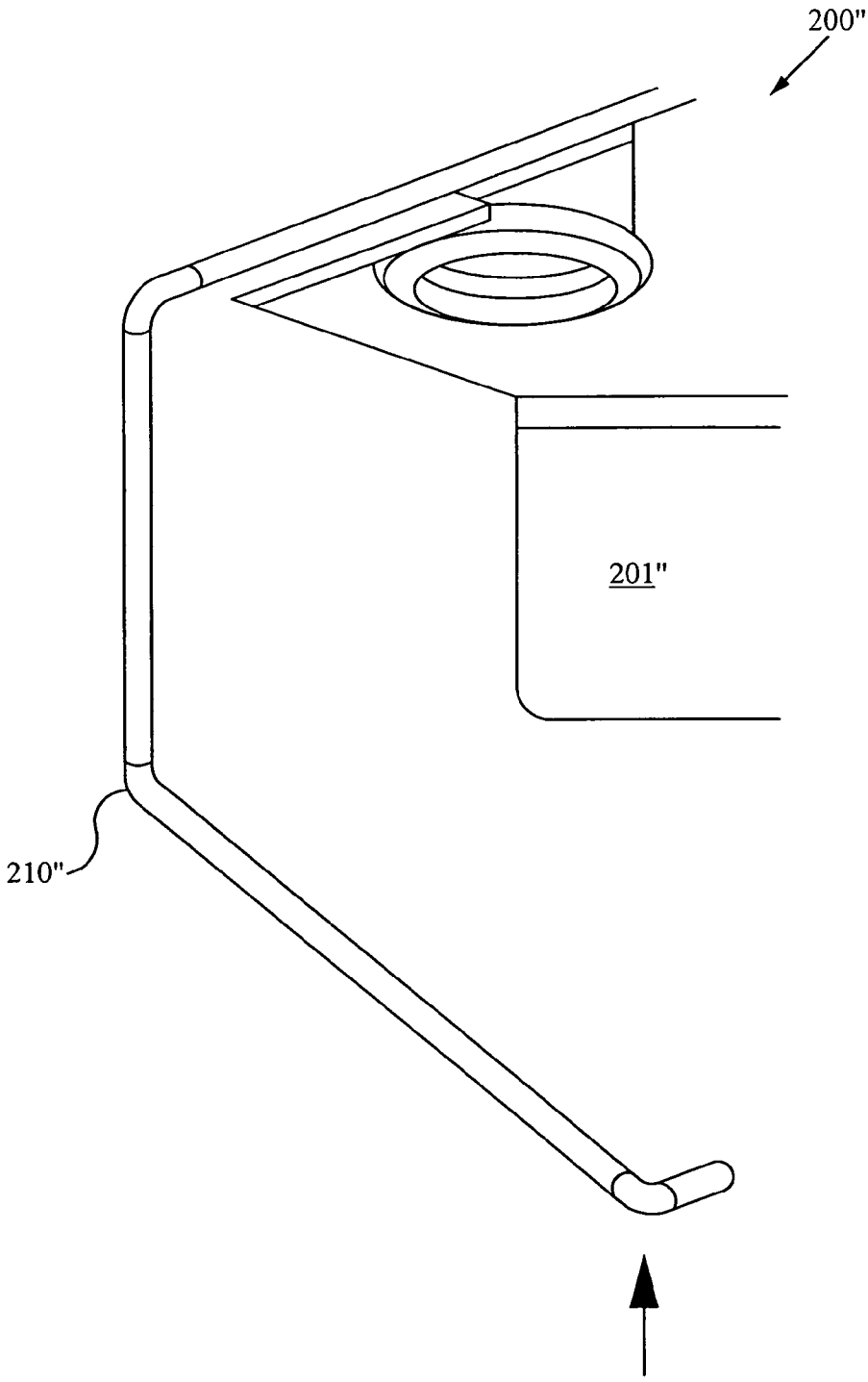
FIG. 1C illustrates a spring clip for a sheet metal antenna.
Figure 2:
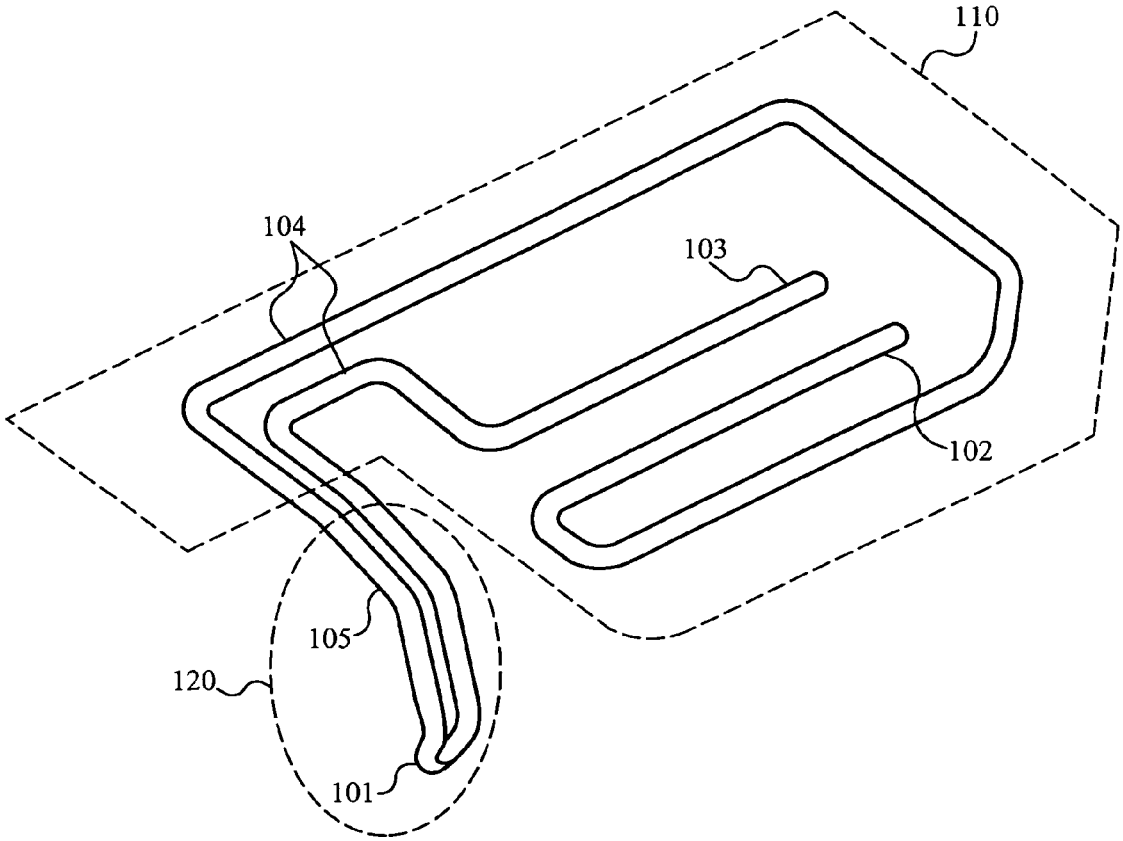
FIG. 2 illustrates an antenna for a mobile device formed from a continuous length of wire consistent with some embodiments of the present invention.

Some embodiments of the present invention are internal antennae for mobile devices. For example, an internal antenna for a mobile device, comprising a continuous length of wire formed into a collection of antenna features. One such antenna is shown in FIG. 2. The antenna is formed of a continuous length of wire with a first end and a second end.

The antenna includes the contact region 101, the first radiator portion 103 and the second radiator portion 102. The antenna comprises the main grouping 110 of portions of the continuous length of wire. The contact region 101 is configured to extend away from the main grouping 110. In the illustrated embodiment the contact region 101 is a loop of the wire located at the end of the extended region 120.

In FIG. 2, the main grouping 110 is configured in a substantially planar arrangement. The extended region 120 is not coplanar with the main grouping 110. Instead, the extended region 120 extends significantly out of the plane of the main grouping 110. The extended region 120 is formed by the curved portions 105 of the first radiator portion 103 and second radiator portion 102.

The first radiator portion 103 comprises a portion of the main grouping 110 and is electrically coupled to the contact region 101. The first radiator portion 103 is also configured such that in operation the first radiator portion 103 acts as a first resonator having a first electrical length.

The second radiator portion 102 also comprises a portion of the main grouping 110 and is also electrically coupled to the contact region 101. In addition, the second radiator portion 102 is configured such that in operation the second radiator portion 102 acts as a second resonator having a second electrical length. Preferably, the second electrical length is greater than the first electrical length.

Preferably, the wire, and thus the antenna, is formed of a material that does not produce an insulating oxide layer when oxidized. Most preferably, the wire is formed of a material that is internally oxidizing.

Some embodiments of the invention relate to the configuration of internal antennae within mobile devices. Preferably, an internal antenna of the type shown in FIG. 2 is installed in a mobile device and configured such that the contact region 101 is in contact with a contact element of the mobile device (not shown). Preferably each member of a set of torsion regions 104 (explained below) is substantially immobilized relative to the other members of the set of torsion regions 104 by structural features of the mobile device designed to retain and support the antenna. Further, the contact element of the mobile device is preferably positioned to, when the antenna is mounted, deform the contact region 101 of the antenna towards the main grouping 110 of the antenna relative to their position when the antenna is not mounted.

Some other embodiments relate to methods of manufacturing internal antennae for mobile devices; for example, manufacturing an internal antenna for a mobile device from a continuous length of wire.

The structure shown in FIG. 2 is producible via a method of manufacturing antenna for a mobile device from a continuous length of wire consistent with the present invention. The wire has a first end and a second end. The steps operate on sub-lengths of the wire. The method comprises several steps. For example, in a first step the first radiator portion 103 is formed from a first sub-length of the wire starting at the first end of the wire. In a second step the contact region 101 is formed from a second sub-length of the wire starting adjacent to an end of the first sub-length. In FIG. 2 the loop forming the contact region 101 defines the end of the first radiator portion 103. In a third step the second radiator portion 102 is formed from a third sub-length of the wire starting adjacent to an end of the second sub-length (the contact region 101) and extending to the second end of the wire.

In the case of FIG. 2, the first step includes a sub-step of configuring the first radiator portion 103 to include a member of a set of torsion regions 104. Similarly, the third step includes a sub-step of configuring the second radiator portion 102 to include a member of the set of torsion regions 104.

In addition, the steps recited form an internal antenna that has a main grouping 110 comprising part of the first radiator portion 103 and part of the second radiator portion 102. As illustrated the contact region 101, being part of the extended region 120, extends away from the main grouping 110.

Because the antenna is formed of a continuous length of conductive wire, the first radiator portion 103 is electrically coupled to the contact region 101. Similarly, the second radiator portion 102 is electrically coupled to the contact region 101. In operation, the first radiator portion 103 acts as a first resonator having a first electrical length. Similarly, in operation second radiator portion 102 acts as a second resonator having a second electrical length. Preferably the second electrical length is greater than the first electrical length.

Function

In some embodiments, such as the one shown in FIG. 2, the main grouping 110 and extended region 120 are configured as a torsion spring that reacts against movement of the contact region 101 towards the main grouping 110. The torsion spring of the main grouping 110 and extended region 120 are configured relative to the contact region 101 such that, when the contact region 101 is displaced towards the main grouping 110, a stress developed within the main grouping 110 and the extended region 120 produces a spring force urging the contact region away from the main grouping. In other words, the contact region 101 has a resting position relative to the main grouping 110 that is the location to which the contact region 110 tends in the absence of an external force.

In these embodiments, the main grouping 110 preferably comprises a set of torsion regions 104, that, when immobilized relative to one another, permit the antenna to react against movement of the contact region 101 towards the main grouping 110. Further, the set of torsion regions 104 preferably comprises a sub-portion of the first radiator portion 103 and a sub-portion of the second radiator portion 102.

Some embodiments of the invention relate to the configuration of internal antennae within mobile devices. Preferably, an internal antenna of the type shown in FIG. 2 is installed in a mobile device and configured such that the contact region 101 is displaced from its resting location by a contact element of the mobile device (not shown), thus producing a contact force between the contact region 101 and the contact element.

In some embodiments, the mounting of the antenna within the mobile device substantially immobilizes the set of torsion regions 104 relative to one another. In such preferred designs, this immobilization permits the antenna to react against movement of the contact region 101 towards the main grouping 110.

Figure 3:
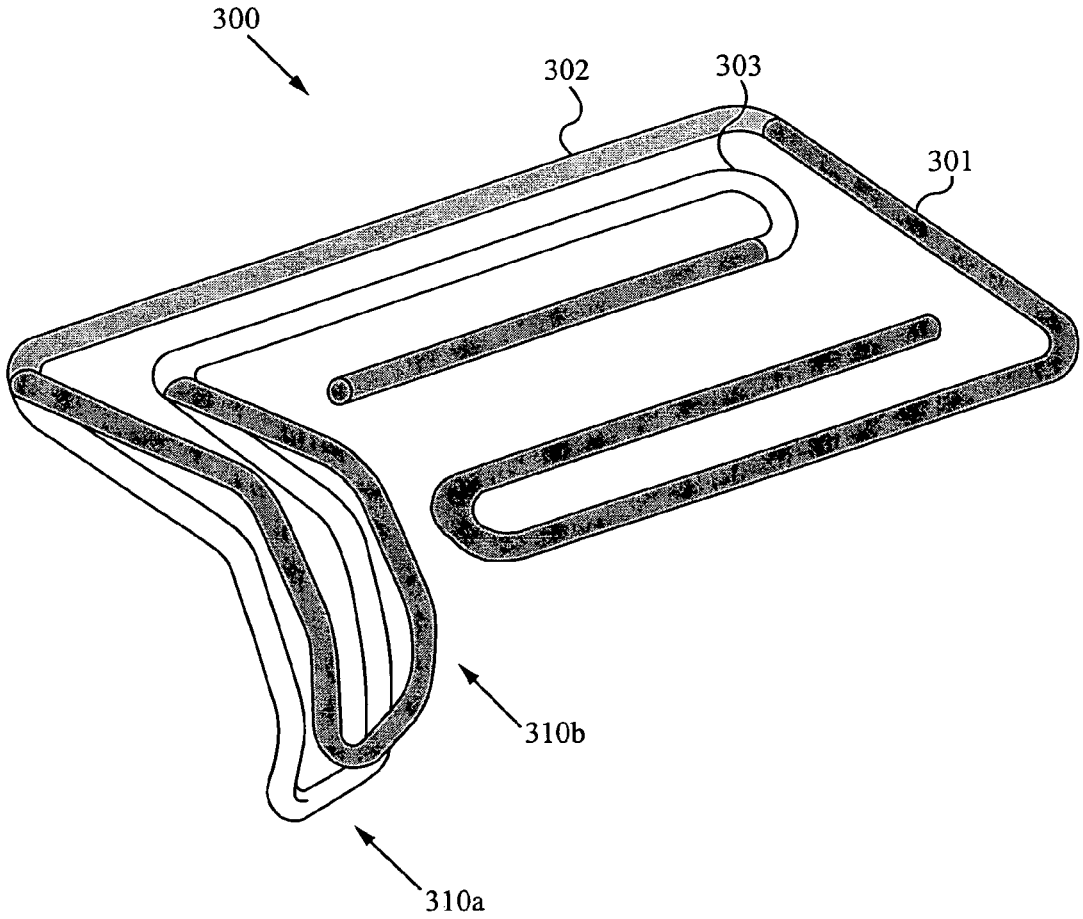
FIG. 3 illustrates forcing within an antenna consistent with some embodiments of the present invention.

As described earlier, preferably the contact region and the main grouping of an antenna are configured relative to one another to form a torsion spring that reacts against movement of the contact region toward the main grouping. FIG. 3 illustrates the functioning of an antenna 300 consistent with the present invention as a torsion spring. 310*a* represents the resting position of the spring, and the resting location of the contact region. 310*b* represents a displacement of the contact region and curved portions of the first and second radiator portions from the resting location.

During displacement 310*b*, stresses are induced within the antenna 300 as illustrated by the shadings 301, 302 and 303. On a rough scale, the displacement 310*b* forms a high strength forcing region 303, a middle strength forcing region 302, and a very low strength forcing region 301. Qualitatively, the density of force formed within the high strength forcing region 303 is an order of magnitude greater than the force density of the middle strength forcing region 302, which is in turn tens of orders of magnitude greater than the force density of the very low strength region 301. The forces formed urge displacement 310*b* toward the resting position 310*a*, thus urging the contact region away from the main grouping.

In some embodiments of the invention that to the configuration of internal antennae within mobile devices, internal antenna of the type shown in FIG. 3 are configured so that they are forced into the displacement 310*b*. Preferably a contact element of the mobile device contacts the contact region of the antenna and is configured such that force formed by the displacement 310*b* urges the contact region against the contact element.

Methods

Some other embodiments relate to methods of manufacturing internal antennae for mobile devices; for example, manufacturing an internal antenna for a mobile device from a continuous length of wire.

Figure 4:
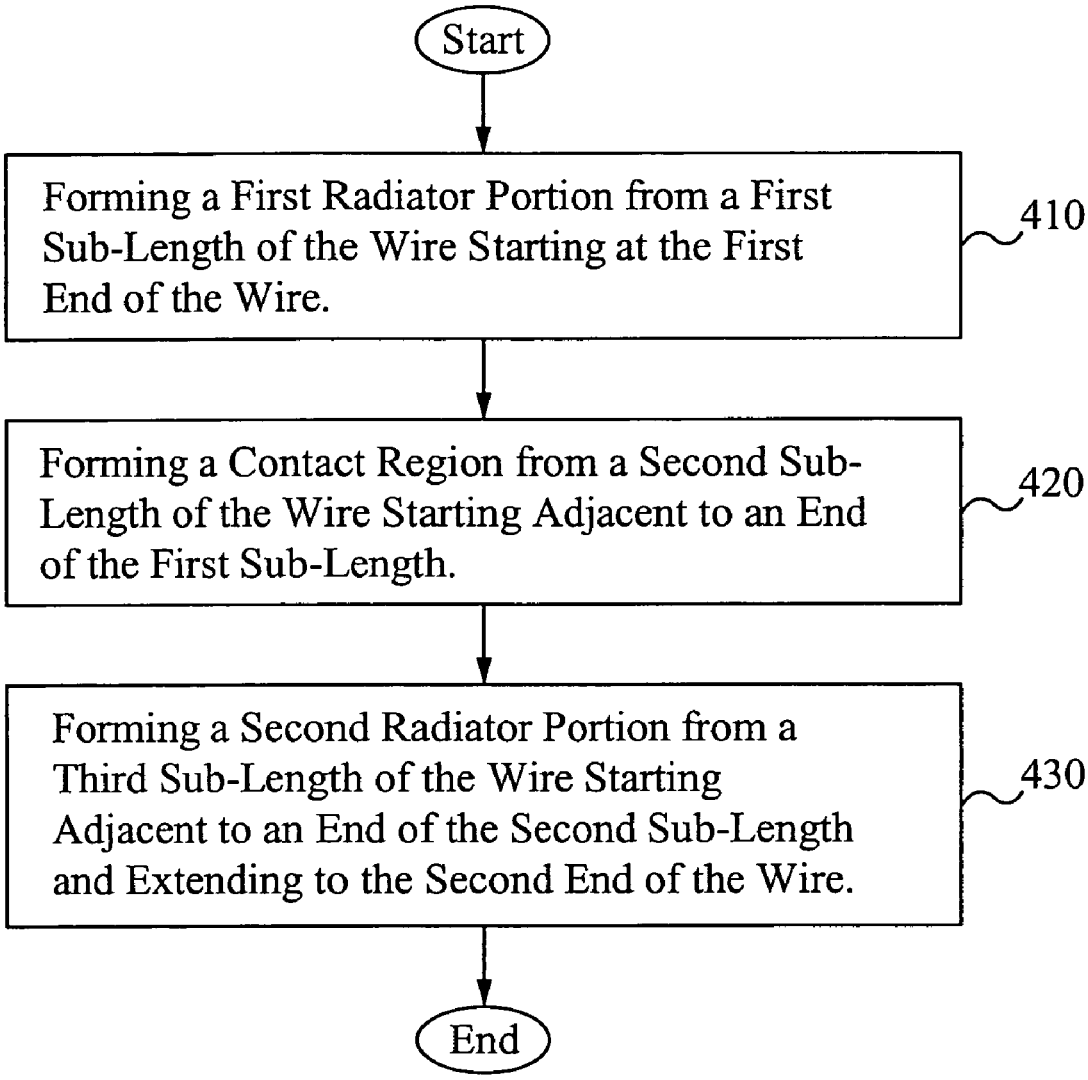
FIG. 4 is a flowchart showing a method of manufacturing an internal antenna consistent with some embodiments of the present invention.

Referring now to FIG. 4, a method consistent with some embodiments of the present invention is shown. The method includes a step 410 of forming a first radiator portion from a first sub-length of the wire starting at the first end of the wire. The method further includes a step 420 of forming a contact region from a second sub-length of the wire starting adjacent to an end of the first sub-length. The method further includes a step 430 of forming a second radiator portion from a third sub-length of the wire starting adjacent to an end of the second sub-length and extending to the second end of the wire.

In some embodiments, the contact region and the main grouping are configured relative to one another to form a torsion spring that reacts against movement of the contact region toward the main grouping.

Preferably, the first step includes a sub-step of configuring the first radiator portion to include a member of a set of torsion regions. Similarly, the third step preferably includes a sub-step of configuring the second radiator portion to include a member of the set of torsion regions.

In addition, the steps recited preferably form an internal antenna that has a main grouping comprising part of the first radiator portion and part of the second radiator portion. The contact region preferably extends away from the main grouping.

The antenna is formed of a continuous length of conductive wire and the first radiator portion is preferably electrically coupled to the contact region. Similarly, the second radiator portion is preferably electrically coupled to the contact region. In operation, the first radiator portion preferably acts as a first resonator having a first electrical length. Similarly, in operation second radiator portion preferably acts as a second resonator having a second electrical length. Preferably the second electrical length is greater than the first electrical length.

Iterative Production and Redesign

Figure 5:
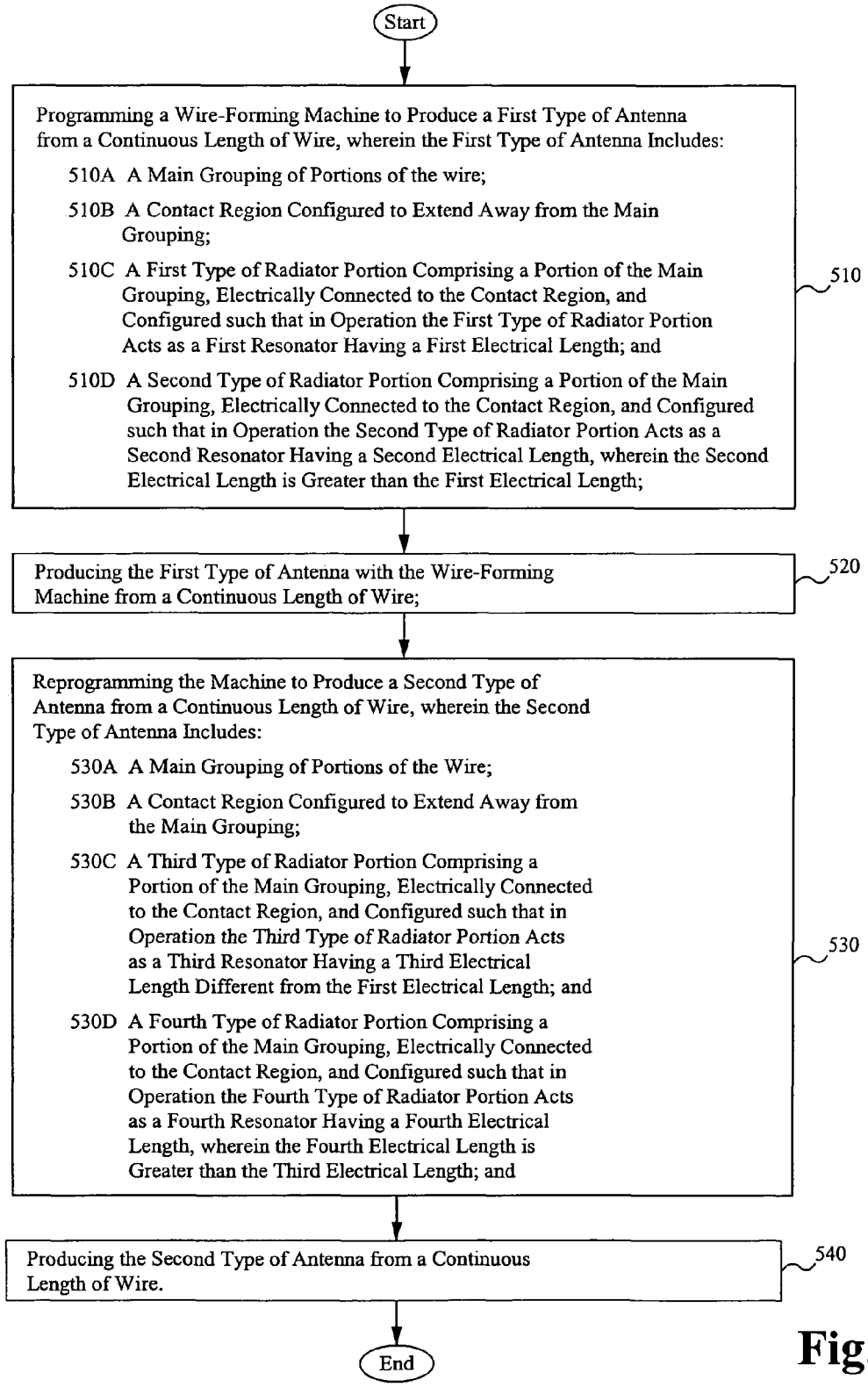
FIG. 5 illustrates an iterative antenna production and re-design cycle consistent with some embodiments of the present invention.

FIG. 5 illustrates an iterative antenna production and redesign cycle, consistent with the present invention. A step 510 consists of programming a wire-forming machine to produce a first type of antenna from a continuous length of wire. Another step 520 consists of producing the first type of antenna with the wire-forming machine from a continuous length of wire. A step 530 consists of reprogramming the machine to produce a second type of antenna from a continuous length of wire. Another step 540 consists of producing a second type of antenna from a continuous length of wire.

The first type of antenna includes: a main grouping 510*a* of portions of the wire, a contact region 510*b*, a first type of radiator portion 510*c*, and a second type of radiator portion 510*d*.

The contact region 510*b* is configured to extend away from the main grouping. The first type of radiator portion 510*c* comprises a portion of the main grouping, electrically coupled to the contact region, and configured such that in operation the first type of radiator portion acts as a first resonator having a first electrical length. The second type of radiator portion 510*d* comprises a portion of the main grouping, electrically coupled to the contact region, and configured such that in operation the second type of radiator portion 510*d* acts as a second resonator having a second electrical length, wherein the second electrical length is greater than the first electrical length.

The second type of antenna includes: a main grouping 530*a* of portions of the wire, a contact region 530*b*, a third type of radiator portion 530*c*, and a fourth type of radiator portion 530*d*.

The contact region 530*b* is configured to extend away from the main grouping. The third type of radiator portion 530*c* comprises a portion of the main grouping, electrically coupled to the contact region, and configured such that in operation the third type of radiator portion acts as a third resonator having a third electrical length different from the first electrical length. The fourth type of radiator portion 530*d* comprises a portion of the main grouping, electrically coupled to the contact region, and configured such that in operation the fourth type of radiator portion 530*d* acts as a fourth resonator having a second electrical length, wherein the fourth electrical length is greater than the third electrical length.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

We claim:

1. An internal antenna for a mobile device, comprising a continuous length of wire formed into:

a. a main grouping of portions of the wire;

b. a contact region configured to extend away from the main grouping;

c. a first radiator portion comprising a portion of the main grouping, electrically coupled to the contact region, and configured such that in operation the first radiator portion acts as a first resonator having a first electrical length, wherein the first radiator portion is within a perimeter of the main grouping; and d. a second radiator portion comprising another portion of the main grouping, electrically coupled to the contact region, and configured such that in operation the second radiator portion acts as a second resonator having a second electrical length, wherein the second electrical length is greater than the first electrical length, wherein the second radiator portion is within the perimeter of the main grouping.

2. The internal antenna of claim 1, wherein the wire is formed of a material that does not produce an insulating oxide layer when oxidized.

3. The internal antenna of claim 2, wherein the wire is formed of a material that is internally oxidizing.

4. The internal antenna of claim 1, wherein the main grouping is configured relative to the contact region such that, when the contact region is displaced towards the main grouping, a stress developed within the main grouping produces a spring force urging the contact region away from the main grouping.

5. The internal antenna of claim 4, wherein the main grouping and the contact region together form a torsion spring that reacts against movement of the contact region towards the main grouping.

6. The internal antenna of claim 4, wherein the main grouping comprises a set of torsion regions, that, when immobilized relative to one another, permit the antenna to react against movement of the contact region towards the main grouping.

7. The internal antenna of claim 6, wherein the set of torsion regions comprises a sub-portion of the first radiator portion and a sub-portion of the second radiator portion.

8. The internal antenna of claim 4, wherein the contact region has a resting location relative to the main grouping that is the location to which the contact region tends in the absence of an external force.

9. The internal antenna of claim 8, wherein the internal antenna is installed in a mobile device and configured such that the contact region is displaced from its resting location by a contact element of the mobile device, thus producing a contact force between the contact region and the contact element.

10. The internal antenna of claim 1, wherein the main grouping is configured in a substantially planar arrangement.

11. The internal antenna of claim 1, wherein the contact region comprises a loop of the wire.

12. An internal antenna for a mobile device, comprising a continuous length of wire formed into:

a. a main grouping of portions of the wire;

b. a contact region configured to extend away from the main grouping, wherein the contact region and the main grouping are configured relative to one another to form a torsion spring that reacts against movement of the contact region toward the main grouping;

c. a first radiator portion comprising a portion of the main grouping, electrically coupled to the contact region, and configured such that in operation the first radiator portion acts as a first resonator having a first electrical length, wherein the first radiator portion is within a perimeter of the main grouping; and d. a second radiator portion comprising another portion of the main grouping, electrically coupled to the contact region, and configured such that in operation the second radiator portion acts as a second resonator having a second electrical length, wherein the second electrical length is greater than the first electrical length, wherein the second radiator portion is within the perimeter of the main grouping.

13. A method of manufacturing an internal antenna for a mobile device from a continuous length of wire, the internal antenna having a main grouping, the method comprising:

a. forming a first radiator portion from a first sub-length of the wire starting at a first end of the wire;

b. forming a contact region from a second sub-length of the wire starting adjacent to an end of the first sub-length; and c. forming a second radiator portion from a third sub-length of the wire starting adjacent to an end of the second sub-length and extending to a second end of the wire such that the first radiator portion and the second radiator portion are formed within a perimeter of the main grouping.

14. The method of claim 13, wherein the main grouping comprises part of the first radiator portion and part of the second radiator portion.

15. The method of claim 13, wherein the contact region extends away from the main grouping.

16. The method of claim 13, wherein the contact region and the main grouping are configured relative to one another to form a torsion spring that reacts against movement of the contact region toward the main grouping.

17. The method of claim 13, wherein the first radiator portion is electrically coupled to the contact region.

18. The method of claim 17, wherein the first radiator portion is configured such that in operation the first radiator portion acts as a first resonator having a first electrical length.

19. The method of claim 13, wherein the second radiator portion is electrically coupled to the contact region.

20. The method of claim 19, wherein the second radiator portion is configured such that in operation the second radiator portion acts as a second resonator having a second electrical length.

21. The method of claim 17 or 19, wherein the second electrical length is greater than the first electrical length.

22. An iterative antenna production and re-design cycle, comprising:

a. programming a wire-forming machine to produce a first type of antenna from a continuous length of wire, wherein the first type of antenna includes:

i. a main grouping of portions of the wire;

ii. a contact region configured to extend away from the main grouping;

iii. a first type of radiator portion comprising a portion of the main grouping, electrically coupled to the contact region, and configured such that in operation the first type of radiator portion acts as a first resonator having a first electrical length; and iv. a second type of radiator portion comprising a portion of the main grouping, electrically coupled to the contact region, and configured such that in operation the second type of radiator portion acts as a second resonator having a second electrical length, wherein the second electrical length is greater than the first electrical length;

b. producing the first type of antenna with the wire-forming machine from a continuous length of wire;

c. reprogramming the machine to produce a second type of antenna from a continuous length of wire, wherein the second type of antenna includes:

i. a main grouping of portions of the wire;

ii. a contact region configured to extend away from the main grouping;

iii. a third type of radiator portion comprising a portion of the main grouping, electrically coupled to the contact region, and configured such that in operation the third type of radiator portion acts as a third resonator having a third electrical length different from the first electrical length; and iv. a fourth type of radiator portion comprising a portion of the main grouping, electrically coupled to the contact region, and configured such that in operation the fourth type of radiator portion acts as a fourth resonator having a fourth electrical length, wherein the fourth electrical length is greater than the third electrical length; and d. producing the second type of antenna from a continuous length of wire.

* * * * *